United States Patent [19]

Barthelemy et al.

[11] Patent Number: 4,480,194

[45] Date of Patent: Oct. 30, 1984

[54] CIRCUIT FOR SUPPLYING A CONTROL CONTACT WITH POWER AND APPLICATION THEREOF TO THE CONTROL OF A REST TIME DELAY OF A RELAY

[75] Inventors: Philippe Barthelemy, Le Vesinet; Gilles Baurand, Montesson; Francois Roussel, Cormeilles En Parisis, all of France

[73] Assignee: La Telemecanique Electrique, France

[21] Appl. No.: 466,192

[22] Filed: Feb. 14, 1983

[30] Foreign Application Priority Data

Feb. 12, 1982 [FR] France ..... 82 02356

[51] Int. Cl.[3] ..... H01H 47/00

[52] U.S. Cl. ..... 307/132 E; 307/140; 307/141.4; 361/196

[58] Field of Search ..... 307/132 E, 137, 141, 307/141.4; 361/196

[56] References Cited

U.S. PATENT DOCUMENTS 3,784,881 1/1974 Van Horn et al. ..... 361/196
3,814,949 6/1974 Weinberg ..... 307/141
4,354,747 10/1982 Borowski et al. ..... 307/132 E
4,415,943 11/1983 Wortman ..... 361/196 X

*Primary Examiner*—Reinhard J. Eisenzopf
*Assistant Examiner*—Derek S. Jennings
*Attorney, Agent, or Firm*—William A. Drucker

[57] ABSTRACT

With this circuit, a current may be caused to flow through a contact (K) controlling the voltage supply of an electronic control circuit (24), of sufficient intensity for the reliability of the contact to be good, without the current flowing in the control circuit (24) being too high and this independently of the supply voltage (terminals E, 44) applied to the supply terminals of the user circuit (U). For this, the control circuit (24) is fed with power when the contact (K) is closed, through said contact (K), a first diode (31) and a resistor (32) connected in series, whereas a piloting circuit (11), which is an integrated time delay or memory circuit associated with said user circuit (U), is then supplied through said contact (K) and a second diode (26). When contact (K) is open, said piloting circuit (11) is fed through a third diode (29) and a Zener diode (30), the second diode (26) then preventing the control circuit (24) from being supplied with power.

5 Claims, 2 Drawing Figures

PILOT CIRCUIT
18
Ia
Ik
A
B
C
D
K
P
L
U
23
24
25

CIRCUIT FOR SUPPLYING A CONTROL CONTACT WITH POWER AND APPLICATION THEREOF TO THE CONTROL OF A REST TIME DELAY OF A RELAY

BACKGROUND OF THE INVENTION

The present invention relates to a circuit for supplying a control contact with power and the application thereof to the control of a rest time delay of a relay.

When it is desired to use a contact for controlling a function on an apparatus fed with AC or DC, comprising components which may be electronic or not requiring a power supply and at least one control signal and working over a wide voltage range (24 V to 240 V for example), it is necessary to have good contact reliability for the control contact, to have flowing therethrough a current of a minimum intensity of the order of about 10 mA for a standard contact.

On the other hand, to control an electronic circuit, it is not necessary to have currents of high intensity. A value of the order of a milliampere may be sufficient, as the circuits are voltage-controlled. Moreover, it is known, if it is desired to work in a large voltage range, to include a series of dropping resistors which will be connected by means of jumpers so as to maintain the current in the contact at an acceptable value without however dissipating too much energy in the control circuit.

OBJECT OF THE INVENTION

It is an object of the present invention to provide a circuit for supplying a control contact with sufficient current while maintaining a current of low intensity in the control circuit independently of the value of the voltage connected to the terminals of the circuit.

Another object of the invention is the application thereof to a rest time delay of a relay.

SUMMARY OF THE INVENTION

A circuit arrangement built in accordance with the principles of the invention comprises:

(a) a user circuit;

(b) power supply circuit means for power supplying the user circuit, said supply circuit means comprising a voltage supply source and pilot circuit means to switch on and off the power supply of the user circuit from said source, said pilot circuit means having a current supply input and a control input;

(c) current supply circuit means having a supply input and an output connected to the current supply input of the pilot circuit means, said current supply circuit providing a substantially constant current at its output when a supply current is applied on its supply input (d) control circuit means having a supply input and an output connected to the control input of the pilot circuit means, said control circuit means providing a substantially constant voltage at its output when a supply current is applied on its supply input;

(e) first circuit means comprising, connected in series: contact switch means, a directly connected first diode, and a resistor connecting the voltage supply source to the supply input of the control circuit means;

(f) a second directly connected diode connecting the junction point between the contact switch means and the first diode to the supply input of the current supply circuit means and (g) second circuit means comprising, connected in series: a third directly connected diode, and a reversely connected Zener diode connecting the voltage supply source to the junction point between the second diode and the supply input of the current supply circuit means.

BRIEF DESCRIPTION OF THE DRAWINGS

Other features and advantages of the invention will appear more clearly from the following description made with reference to the accompanying drawings, in which.

DESCRIPTION OF THE PREFERRED EMBODIMENT

Figure 1:
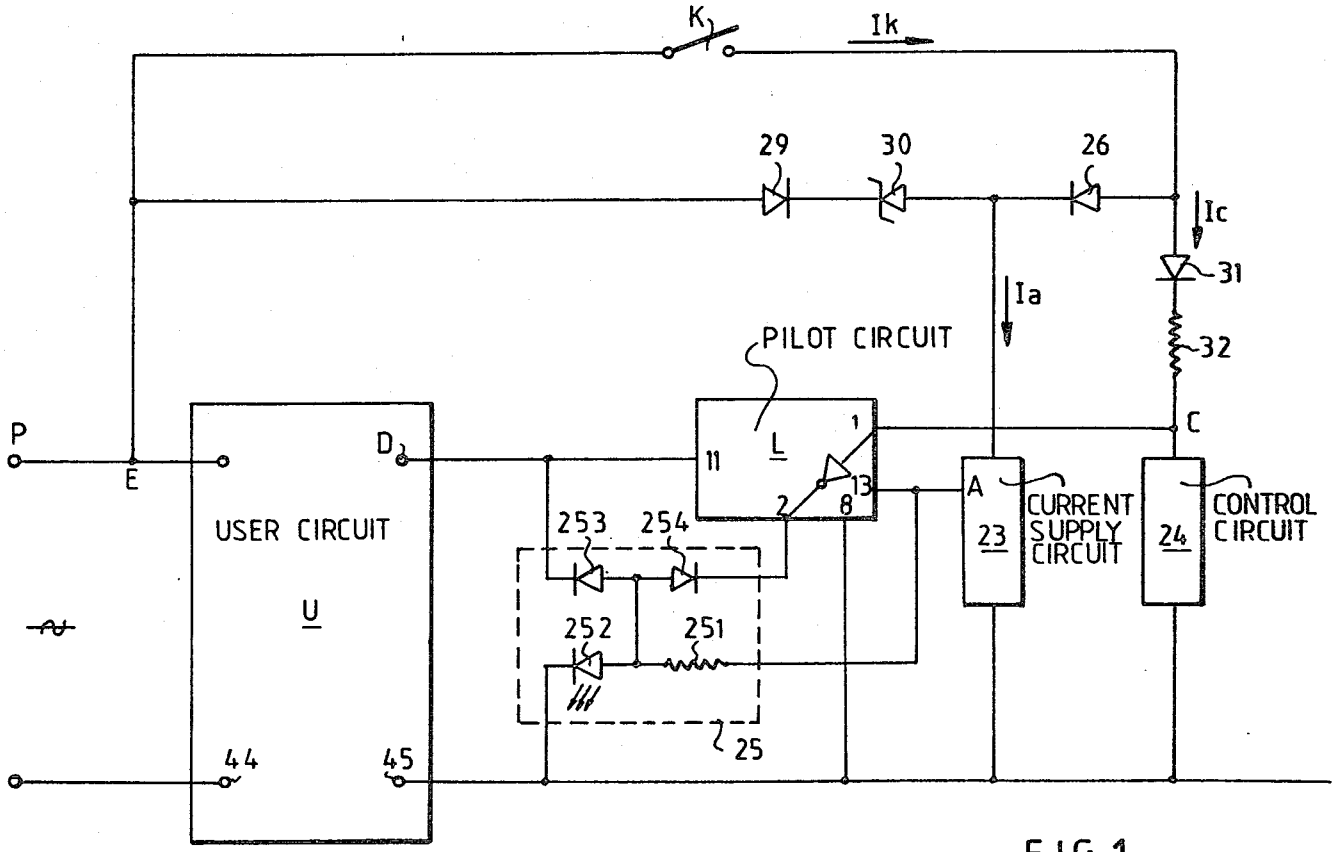
FIG. 1 is a general diagram of a circuit built in accordance with a preferred embodiment of the invention.

FIG. 1 shows a user circuit U connected by its two input terminals E, 44, to a voltage supply source which may vary over a wide range. For example, this range may extend from 24 V to 240 V. The input terminal E is also connected by a switch K to a first diode 31 connected by its cathode to a resistor 32 of high ohmic value and to a control circuit 24 providing at C a substantially continuous and stabilized control voltage Uc. Circuit 24 is connected to the record output terminal 45 of the user circuit.

Across switch K is connected in parallel a series circuit formed by a third diode 29 whose cathode is connected to the cathode of a Zener diode 30 which is in turn connected by its anode to the cathode of a second diode 26 whose anode is connected to the anode of the first diode 31.

A current supply circuit 23, connected on the one hand, to the junction point between the Zener diode 30 and diode 26 and, on the other hand, to terminal 45, provides at its output A a practically constant current which is sufficient for supplying at 13 an integrated piloting circuit L, whose output 11 is connected to the first output terminal D of the user circuit, said piloting circuit having at least one control input which is connected at C.

Figure 2:
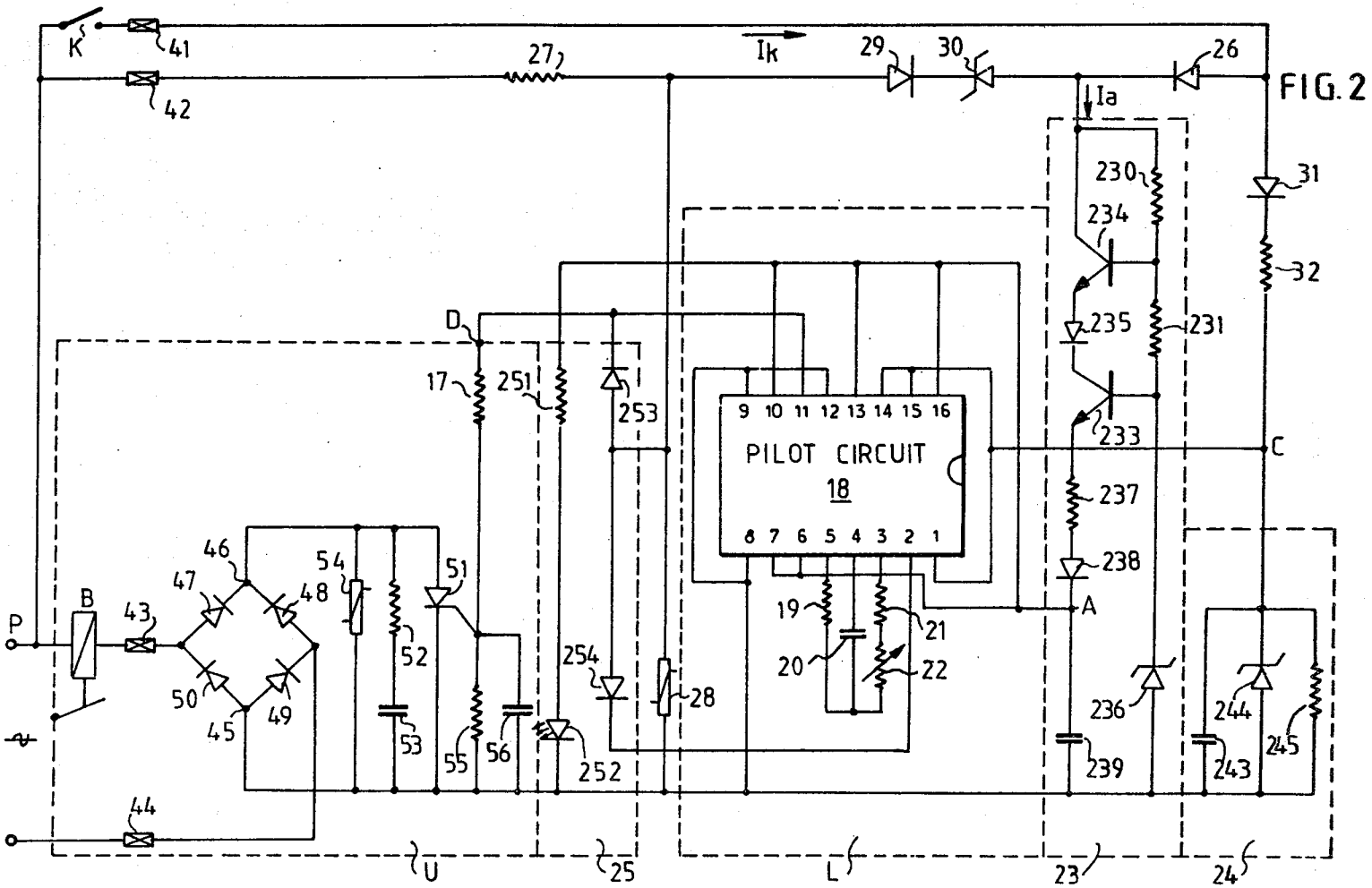
FIG. 2 shows a detailed electronic diagram of an embodiment in which the piloting circuit is adapted for delaying the switching off of the coil of a relay. The same reference numerals denote similar components in FIGS. 1 and 2.

In a non limiting application illustrated in FIG. 2, the integrated circuit L will be formed by an oscillator and a pulse counter serving as a time delay unit and the user circuit will be a relay whose power supply is controlled by a static switch triggered by the time delay.

With the circuit as illustrated in FIG. 1, from an AC or DC voltage source connected across terminals F and 44 and varying over a wide range, a circuit may be controlled by a switch K which will always have flowing therethrough a current sufficient to ensure good contact reliability, while limiting the energy dissipated in the control circuit 24.

When contact K is open, the supply current Ia required for circuit 23, flows through diodes 29 and 30. Diode 26 prevents the supply current from passing into the control circuit 24.

On the other hand, when control switch K is closed, the supply current $I_a$, because of the voltage of the Zener diode 30, does not flow in branch 29, 30, but passes through the control switch K and the diode 26. Then, switch K has flowing therethrough the current $I_a$ required for supplying circuit 23 and the current Ic required for the control circuit (which is negligible with respect to the supply current $I_a$).

Thus the reliability of contact K is improved, whereas, if only the current Ic was caused to flow in K, the said contact would not have sufficient contact reliability.

On the other hand, by choosing for resistor 32 a high value, it is certain that current Ic will be small, even when the supply voltage increases, and consequently little energy will be dissipated.

The circuit of FIG. 1 further comprises a signalling circuit 25 comprising a light emitting diode 252, connected at 45, a resistor 251, connected to point A, a diode 253 connected to the output 11 of the integrated circuit L and a diode 254 connected to a further output 2 of circuit L; the output 2 is connected at point C through an internal inverter of circuit L.

Thus, diode 252 only lights up when contact K is open and the output 11 is at a high level.

FIG. 2 shows a rest time delay unit for a relay, comprising four input terminals 41 to 44, in which terminals 43 and 44 are connected in series through the coil of the relay to be controlled, with an AC or DC voltage source.

Terminal 42 is connected directly to one of the terminals P of the AC voltage source, whereas terminal 41 is connected to terminal P of the source through a contact K controlling the time delay.

To terminals 43 and 44 is connected a diode bridge 47, 48, 49, 50, forming a rectifier for providing a unidirectional flow of current through a thyristor 51.

Thyristor 51 is connected by its anode to the output terminal 46 of the diode bridge and by its cathode to the output terminal 45 of the diode bridge. A series circuit, including a resistor 52 and a capacitor 53, is connected in parallel across the thyristor to protect it against high dV/dt at the time when it is switched on.

A clipper circuit 54 is also connected in parallel across the thyristor to protect it against excessive voltage surges, the clipping voltage being of the order of 600 Volts. The gate of the thyristor is connected, through a resistor 55 in parallel with the capacitor 56, to the cathode of the thyristor connected to terminal 45.

On the other hand, this gate is also connected through a resistor 17 to the output 11 of a CMOS "EFCIS" circuit 18 of the EFB8305 type. Circuit 10 comprises flip-flop means for counting recurrent pulses generated by an adjustable oscillator and applied to output 11.

A potentiometer 22 enables one to effect a first adjustment of the frequency of the oscillator. On the other hand, since the wiring of the CMOS circuit is effected once and for all during manufacture, it is possible to predetermine a number of pulses after which the counter will no longer supply the gate of the thyristor.

By connecting terminals 6 and 7 of circuit 18 to point A or to terminal 45, the said predetermined number of pulses may be modified in accordance with a table given by the constructor of circuit 18. As will be explained hereinafter, the general operation of the circuit of FIG. 2 is as follows:

On closure of contact K, the gate of the thyristor 51 is supplied with power from pulse output 11 of circuit 18 and the thyristor conducts.

On opening of contact K, a signal which starts the counting is given. Thyristor 51, after an adjustable time which corresponds to the generation of the above mentioned predetermined member of pulses, ceases to conduct, no longer supplying the load to be controlled.

The CMOS circuit 18 comprises automatic internal resetting of the counting flip-flops each time the supply voltage disappears.

Circuit 18 must be connected by its terminals 8, 9, 12 to terminal 45. For operation, circuit 18 must be supplied by a supply circuit whose output A is connected to terminals 16, 13, 10 of circuit 18 and controlled by a control circuit 24 whose output C is connected to terminals 1, 14, 15 of circuit 18.

A resistor 27, limiting the current in the case of an overvoltage, is connected to terminal 42 on the one hand and, on the other hand, to terminal 45 of the bridge by a clipping circuit 28 protecting the supply circuit. The junction point between resistor 27 and the clipping circuit 28 is connected to the anode of a diode 29 effecting half-wave rectification whose cathode is connected to a reversely-connected Zener diode 30. The anode of Zener diode 30 is connected, on the one hand, to the cathode of a diode 26 and, on the other hand, to the collector of a first NPN transistor 234 whose emitter is connected to the collector of a second NPN transistor 233, through a diode 235 providing a protection against parasites and overvoltages and which is forwardly-connected.

The emitter of the second transistor 233 is connected to terminal 45 through a resistor 237 in series with forwardly-connected diode 238, avoiding reverse biasing of the base-emitter junction of transistor 233 during a cut in the mains supply, and a capacitor 239 for maintaining a stabilized power supply level.

The collector of the first transistor 234 is connected through a resistor 230 to its base which itself is connected to the base of the second transistor 233 through a resistor 231.

Finally, the base of the second transistor 233 is connected to terminal 45 through a reversely-connected stabilizing Zener diode 236.

The common point A between diode 238 and capacitor 239 is connected to the supply inputs of the CMOS circuit.

The anode of diode 26 is connected, on the one hand, to terminal 41 and, on the other hand, to the anode of a diode 31, effecting half-wave rectification.

The cathode of this rectifying diode 31 is connected through a resistor 32 to point C which is connected to the control input of the CMOS circuit on the one hand, and on the other hand, to the terminal 45 through a circuit 24 supplying a stabilized and smoothed control voltage Uc. Control circuit 24 is formed by a capacitor 243, a Zener diode 244, and a resistor 245, connected in parallel.

A signalling circuit 25 is connected through a resistor 251 to supply point A, through the cathode of a light emitting diode 252 to terminal 45, and through two diodes 253 and 254, whose cathodes are connected respectively to the outputs 11 and 2 of the CMOS circuit and each having the anode connected to the point common to resistor 251 and to diode 252.

The terminal 2 of circuit 18 is connected through an inverter circuit internal to circuit 18 to terminal 1, at which the control signal Uc arrives.

By its connection, it will be readily understood that the light-emitting diode will light up when two conditions are fulfilled simultaneously:

conduction of the thyristor and switch K open, that is to say during the time delay period.

In operation, diodes 29, 30, 26 are connected so that diode 29 is forwardly biased and diode 26 reversely biased when contact K is open, which allows the current flowing through terminal 42 to current supply the supply circuit 23, whereas the control circuit 24 is not supplied.

On the other hand, when contact K is closed, diode 29 is disabled and the voltage across the Zener diode 30 prevents the current of the supply circuit 23 from flowing in the branch 27, 29, 30.

Thus, the current which comes from contact K serves for supplying, on the one hand, the control circuit 24, on the other hand, the current supply circuit 23 through diode 26.

By closing contact K, the control of the CMOS circuit is immediately supplied with power and the gate of the thyristor is supplied through the CMOS circuit 18.

The thyristor conducts and allows the relay to be supplied with power, as long as contact K remains closed.

On opening the contact, the CMOS circuit, supplied by the supply circuit 23, will start counting the pulses. After an adjustable time, corresponding to a given number of pulses to be counted, this circuit no longer supplies the gate of the thyristor and, consequently, the coil B of the relay is no longer supplied with power.

We claim:

1. A circuit arrangement comprising:

(a) a user circuit;

(b) power supply circuit means for power supplying the user circuit, said supply circuit means comprising a voltage supply source and pilot circuit means to switch on and off the power supply of the user circuit from said source, said pilot circuit means having a current supply input and a control input;

(c) current supply circuit means having a supply input and an output connected to the current supply input of the pilot circuit means, said current supply circuit providing a substantially constant current at its output when a supply current is applied on its supply input (d) control circuit means having a supply input and an output connected to the control input of the pilot circuit means, said control circuit means providing a substantially constant voltage at its output when a supply current is applied on its supply input;

(e) first circuit means comprising, connected in series: contact switch means, a directly connected first diode, and a resistor connecting the voltage supply source to the supply input of the control circuit means;

(f) a second directly connected diode connecting the junction point between the contact switch means and the first diode to the supply input of the current supply circuit means and (g) second circuit means comprising, connected in series: a third directly connected diode, and a reversely connected Zener diode connecting the voltage supply source to the junction point between the second diode and the supply input of the current supply circuit means.

2. A circuit arrangement as claimed in claim 1, wherein the said control circuit means comprises, connected in parallel between the supply input thereof and the power supply circuit means: a capaciter, a Zener diode and a resistor.

3. A circuit arrangement as claimed in claim 1, wherein the current supply circuit means comprises, connected in series between its supply input and its output: a first transistor, a directly connected diode, a second transistor, a resistor and a further directly connected diode; said current supply circuit means further comprising a capacitor connecting its output to the power supply circuit means, the first and second transistors each having a base, a first resistor connecting the supply input of said current supply circuit means to the base of the first transistor, a second resistor connecting the base of the first transistor to the base of the second transistor and a reversely connected Zener diode connecting the base of the second transistor to the junction point between the said capacitor and the said power supply circuit means.

4. A circuit arrangement as claimed in claim 1, wherein the user circuit comprises a relay having an energizing coil; the said power supply circuit means comprises:

(a) a diode bridge having first and second diagonals, said energizing coil being connected across the first diagonal;

(b) a parallel circuit connected across the second diagonal, said parallel circuit comprising a thyristor having a gate and serially connected resistor and capacitor connected across said thyristor;

(c) a further resistor connecting the said gate to the diode bridge and a further capacitor connected in parallel across said further resistor; and said pilot circuit means comprises: means for counting an adjustable predetermined member of recurrent pulses each time, due to opening of the said contact switch means, the control circuit means stops providing a substantially constant current on its supply input; said pilot circuit means having a pulse output and a resistor connecting said pulse output of the pilot circuit means to the junction point between said gate and said further resistor and further capacitor.

5. A circuit arrangement as claimed in claim 4, said circuit arrangement further comprising: signalling circuit means comprising a resistor connected to the output of the current supply circuit means, a directly connected light emitting diode connecting the resistor to the junction point between the said further resistor and further capacitor and said diode bridge, a first diode connecting the junction point between the light emitting diode and the resistor to the said pulse output, a second diode, reversely connected with respect to the first diode, connecting the junction point between the first diode and the light emitting diode to a further output of the pilot circuit means, which is logically inverted with respect to the control input thereof.

* * * * *